US009205661B2

(12) United States Patent
Kawate

(10) Patent No.: US 9,205,661 B2
(45) Date of Patent: Dec. 8, 2015

(54) INK CARTRIDGE AND PRINTER

(71) Applicant: SEIKO EPSON CORPORATION, Tokyo (JP)

(72) Inventor: Hiroyuki Kawate, Yamanashi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/751,382

(22) Filed: Jan. 28, 2013

(65) Prior Publication Data

US 2013/0321536 A1 Dec. 5, 2013

(30) Foreign Application Priority Data

May 31, 2012 (JP) ..... 2012-124140

(51) Int. Cl.
*B41J 2/175* (2006.01)

(52) U.S. Cl.
CPC ..... *B41J 2/17553* (2013.01); *B41J 2/1752* (2013.01)

(58) Field of Classification Search
USPC ..... 347/85–86
See application file for complete search history.

(56) References Cited

U.S. PATENT DOCUMENTS

| | | | | |
|---|---|---|---|---|
| 6,361,136 | B1 * | 3/2002 | Watanabe et al. | 347/7 |
| 6,454,400 | B1 | 9/2002 | Morita et al. | |
| 6,631,982 | B2 * | 10/2003 | Sasaki et al. | 347/85 |
| 7,029,104 | B2 * | 4/2006 | Sakai et al. | 347/86 |
| 7,249,821 | B2 * | 7/2007 | Sakai et al. | 347/19 |
| 7,699,453 | B2 * | 4/2010 | Ishizawa et al. | 347/86 |
| 7,883,010 | B2 * | 2/2011 | Sasazaki | 235/380 |
| 8,052,260 | B2 | 11/2011 | Hattori | |
| 2002/0175979 | A1 * | 11/2002 | Morita et al. | 347/86 |
| 2006/0139422 | A1 * | 6/2006 | Hatasa et al. | 347/86 |
| 2006/0244795 | A1 * | 11/2006 | Hayasaki et al. | 347/86 |
| 2009/0303298 | A1 * | 12/2009 | Ujita et al. | 347/86 |
| 2010/0289847 | A1 * | 11/2010 | Ishizawa et al. | 347/19 |
| 2011/0090272 | A1 * | 4/2011 | Matsuo | 347/10 |
| 2011/0096111 | A1 * | 4/2011 | Matsuo | 347/10 |
| 2011/0234658 | A1 * | 9/2011 | Nozawa | 347/7 |
| 2011/0234718 | A1 * | 9/2011 | Kawate | 347/86 |
| 2012/0056958 | A1 * | 3/2012 | Nozawa et al. | 347/87 |
| 2012/0293590 | A1 * | 11/2012 | Yoshida et al. | 347/86 |

FOREIGN PATENT DOCUMENTS

| | | |
|---|---|---|
| JP | 2000-127444 A | 5/2000 |
| JP | 2009-132116 A | 6/2009 |
| JP | 2010-023458 A | 2/2010 |

* cited by examiner

*Primary Examiner* — Matthew Luu
*Assistant Examiner* — Lily Kemathe
(74) *Attorney, Agent, or Firm* — Global IP Counselors, LLP

(57) ABSTRACT

An ink cartridge is adapted to be mounted in a holder of a printer, and includes first to third surfaces and a pressing section. The first and second surfaces face each other. The third surface has first and second end sections respectively adjacent to the first and second surfaces. The pressing section presses the ink cartridge to a second surface side when the ink cartridge is mounted in the holder. The third surface has a detection section which optically detects a remaining state of ink in the ink cartridge, and an abutting section which abuts against the holder. A distance between the detection section and the second end section is shorter than a distance between the detection section and the first end section in the third surface, and the abutting section is positioned between the detection section and the second end section.

11 Claims, 14 Drawing Sheets

INK CARTRIDGE AND PRINTER

CROSS-REFERENCE TO RELATED APPLICATIONS

This application claims priority to Japanese Patent Application No. 2012-124140 filed on May 31, 2012, the disclosure of which are hereby incorporated herein by reference in its entirety.

TECHNICAL FIELD

The present invention relates to an ink cartridge and a printer.

BACKGROUND ART

Typically, a removable ink cartridge is mounted in ink jet type printers. A detection section such as a prism for optically detecting the remaining state of ink in the inner portion is provided in some ink cartridges. Since it is possible to remove the ink cartridge, it is necessary to reliably perform mounting in a defined position and to detect the remaining state of the ink at the correct position when the ink cartridge is mounted in the printer. For example, in Japanese Laid-open Patent Application Publication No. 2010-23458, as shown in FIG. 14, an ink cartridge 1J is rotated and mounted with a first engagement section 21J as the center of rotation. Then, a position aligning pin 170J and the inside of a position aligning hole 70J are brought into contact and the positional alignment of the ink cartridge 1J is performed by receiving a repulsive force in the direction of an arrow J using a support member 30J which is able to displace the ink cartridge 1J. As a result, a remaining amount detecting sensor 161J of the printer opposes a prism 60J as the detection section with high precision, and it is possible to accurately perform detection of the remaining state of the ink in the ink cartridge.

SUMMARY

However, in Japanese Laid-open Patent Application Publication No. 2010-23458, in a case where there are individual differences in the outer dimensions of the ink cartridges, the engagement positions of the printer and the ink cartridges, or the like, there is a possibility that the ink cartridge may rotate with the first engagement section 21J as the center of rotation and the ink in the inner portion may be inclined. At this time, it is thought that since the prism is disposed at a position far from the center of rotation, the inclination of the ink is even more remarkable and precision of the detection of the remaining state of ink is reduced.

The present invention was created in order to solve at least a portion of the problem described above and it is possible to realize the present invention as the following forms or aspects.

According to one aspect, an ink cartridge is adapted to be mounted in a holder of a printer and which has a first surface, a second surface which opposes the first surface, and a third surface which has a first end section which is adjacent to the first surface and a second end section which is adjacent to the second surface. The ink cartridge includes a pressing section which presses the ink cartridge to the second surface side when the ink cartridge is mounted in the holder, wherein the third surface has a detection section which is used for optically detecting the remaining state of ink which is contained in the ink cartridge and an abutting section which abuts against the holder, and a distance between the detection section and the second end section is shorter than a distance between the detection section and the first end section in the third surface, and the abutting section is positioned between the detection section and the second end section.

According to the ink cartridge described above, in a state where the ink cartridge is mounted in the holder of the printer, the ink cartridge is pressed to the second side surface by the pressing section of the first surface. In the third surface, the distance between the detection section and the second end section is shorter than the distance between the detection section and the first end section. That is, the detection section is positioned near to the second surface side which is the pressing direction. In addition, the abutting section which abuts against the holder is positioned more to the second surface side than the detection section.

In the configuration described above, in a case where there are individual differences in the outer dimensions of the ink cartridges, the mounting position of the ink cartridge into the holder, or the like, the ink cartridge is rotated with the abutting section near to the second surface side as the center of rotation. Due to this rotation, the ink cartridge is inclined and the ink which is contained therein is also inclined. At this time, since the detection section is near to the second surface side and the abutting section, it is possible to reduce the inclination of the ink which is the target to be detected using the detection section compared to a case where the detection section is far from the second surface side and the abutting section. As a result, it is possible to suppress the reduction of the precision of the detection of the remaining state of the ink due to the inclination of the ink.

In the ink cartridge described above, the third surface preferably further has an ink supply port which supplies ink to the printer, and a distance between the ink supply port and the second end section is longer than a distance between the ink supply port and the first end section in the third surface.

According to the ink cartridge described above, the ink supply port is positioned near to the first surface side and receives or abuts against an ink supply section such as an ink supply needle which is provided in the holder. Due to this, the ink cartridge is stabilized and supported from the holder by both the ink supply port, which is positioned at the first surface side, and the abutting section, which is positioned at the second surface side, in the third surface.

In the ink cartridge described above, the abutting section preferably protrudes from the third surface.

According to the ink cartridge described above, it is possible to avoid a reduction in the volume of ink which is able to be contained by forming the abutting section. Furthermore, it is possible to easily provide the abutting section with regard to the third surface.

In the ink cartridge described above, an angle which is formed by the mounting direction of the ink cartridge into the holder and the third surface is preferably 90 degrees or less when the ink cartridge is mounted in the holder.

According to the ink cartridge described above, in a case where there are individual differences in the ink cartridges, it is possible to reliably set the abutting section as the center of rotation when the ink cartridge is pressed to the second surface side by the pressing section of the first surface.

In the ink cartridge described above, the abutting section is preferably formed by a member which absorbs light.

According to the ink cartridge described above, it is possible to suppress the adverse effects of reflected light from the abutting section when the remaining state of the ink is optically detected. As a result, it is possible to improve the precision of the detection of the remaining state of the ink.

In the ink cartridge described above, the first surface preferably further has a plurality of cartridge side terminals which have contact sections which are electrically connected to a plurality of apparatus side terminals which are provided in the holder, and the contact sections are positioned in the first surface between the pressing section and the first end section.

In a case where there are individual differences in the ink cartridges, positional deviations also occur with regard to the contact sections with the abutting section as the center of rotation. At this time, when the contact sections of the cartridge side terminals are positioned between the pressing section and the first end section, it is possible to reduce the positional deviation with the apparatus side terminals of the holder with the contact section near to the abutting section compared to the other positions in the first surface. As a result, it is possible to suppress contact defects between the cartridge side terminals and the apparatus side terminals.

In the ink cartridge described above, the contact section preferably has a first contact section row and a second contact section row which are arranged in a direction which intersects with the mounting direction of the ink cartridge into the holder, the first contact section row is positioned in the first surface between the first end section and the second contact section row, and the number of the terminal sections which are included in the first contact section row is larger than the number of the terminal sections which are included in the second contact section row.

According to the ink cartridge described above, when considering positional deviation of the contact section with the abutting section as the center of rotation, the first contact section row is nearer to the abutting section than the second contact section row. As such, it is possible to reduce the positional deviation of the first contact section row, where the number of cartridge side terminals is large, more than the second contact section row, where the number of cartridge side terminals is small.

In the ink cartridge described above, the number of the contact sections which are included in the first contact section row is preferably an odd number, and the cartridge side terminal, which includes the contact section which is positioned in the center of the arrangement of the first contact section row, is a ground terminal.

Circuitry or a storage device may be provided on the cartridge so as to be connected to at least a portion of the cartridge side terminals. For example, when a high voltage is applied by accident to the cartridge side terminals, there is a possibility that a fault may occur in the circuitry or the storage device. In order to reduce the occurrence of such faults, apparatus side ground terminals are provided in the holder so as to protrude more than the other apparatus side terminals. When the apparatus side ground terminals are provided so as to protrude more than the other apparatus side terminals, it is possible to connect the ground terminals faster than the connection of the other terminals at the cartridge side and the holder side. Here, if the apparatus side ground terminals are provided so as to protrude more than the other apparatus side terminals, when the cartridge is mounted in the holder, a stronger force is applied to the contact sections which are in contact with the apparatus side ground terminals than to the contact sections which are in contact with the other apparatus side terminals. According to the ink cartridge described above, in a case where the apparatus side ground terminals are provided in the holder so as to protrude more than the other terminals, an even stronger force is applied to the center of the arrangement of the contact sections of the cartridge side terminals. As such, it is possible to prevent the posture of the ink cartridges being inclined by the even stronger force. That is, it is possible to maintain the ink cartridge in the stabilized correct posture.

In the ink cartridge described above, the area of the ground terminal is preferably larger than the area of the terminals other than the ground terminal in the circuit board.

According to the ink cartridge described above, the apparatus side ground terminal of the holder and the cartridge side ground terminal are more reliably brought into contact than the other terminals. Due to this, it is possible to reduce the occurrence of faults as described above.

In the ink cartridge described above, the cartridge side terminals are preferably provided in a surface of a circuit board, and a region on the surface of the circuit board which excludes a region between a terminal row, which includes the contact sections which configure the first contact section row, and the end section of the mounting direction side, is coated with a film.

According to the ink cartridge described above, in the surface of the circuit board where the cartridge side terminals are provided, the surface between the first terminal row and the end section of the mounting direction side is not coated with a film. Due to this, when the ink cartridge is mounted in the holder, it is possible to avoid ground up matter or the like, which is generated by the sliding of the apparatus side terminals of the holder and the surface of the circuit board, being attached to the apparatus side terminals. As a result, it is possible to suppress the contact between the apparatus side terminals and the cartridge side terminals from being insufficient.

According to another aspect, a printer includes a holder where the ink cartridge described above is mounted.

According to the printer described above, in a case where there are individual differences in the outer dimensions of the ink cartridges, the mounting position of the ink cartridge into the holder, or the like, it is possible to suppress reduction of the precision of the detection of the remaining state of the ink due to the inclination of the ink.

DESCRIPTION OF THE EMBODIMENTS

Below, an ink cartridge according to an embodiment will be described with reference to the diagrams.

Configuration of Printing Apparatus

Figure 1:
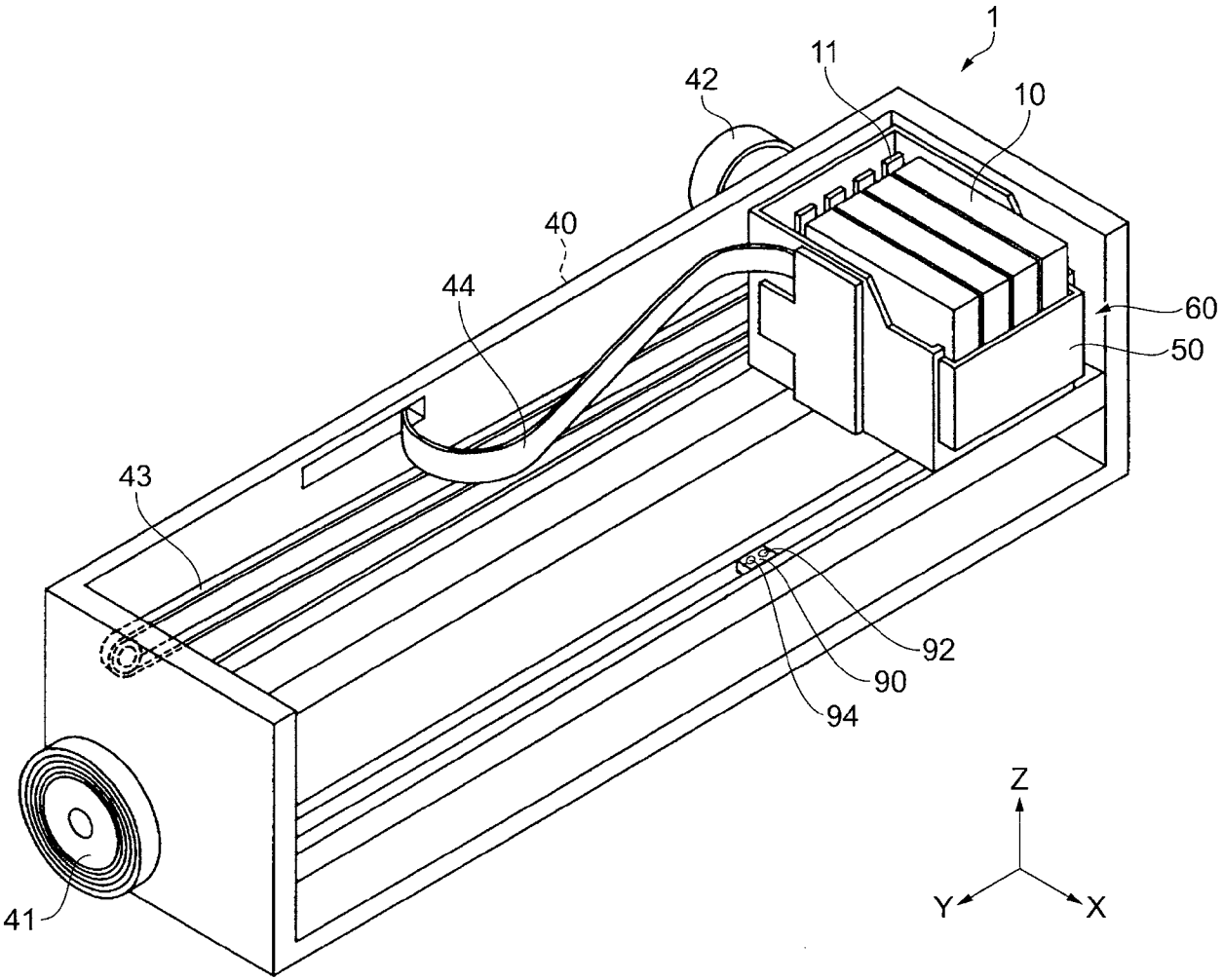
FIG. 1 is a perspective diagram illustrating a configuration of a printing apparatus.

FIG. 1 is a perspective view illustrating a configuration of a printing apparatus in the present embodiment. XYZ axes which are orthogonal to each other are drawn in FIG. 1. The XYZ axes of FIG. 1 correspond to the XYZ axes in the other diagrams and the XYZ axes are given as necessary for the diagrams which are shown below. Here, in the usage posture of a printing apparatus 1, the Z axis direction (the Z direction and the −Z direction) is the vertical direction.

The printing apparatus 1 is an ink jet printer and has a sub-scanning feeding mechanism, a main scanning feeding mechanism, and a head driving mechanism. The sub-scanning feeding mechanism transports printing paper in the sub-scanning direction using moving force of a paper feeding motor 41. The main scanning feeding mechanism reciprocally moves a carriage 60 which is connected to a driving belt 43 in the main scanning direction using the moving force of a carriage motor 42. Here, the main scanning direction in the printing apparatus 1 is the Y axis direction (the Y direction and the −Y direction) and the sub-scanning direction is the X axis direction (the X direction and the −X direction). The head driving mechanism drives the printing head (which is not shown in the diagram) which is provided in the carriage 60 and performs discharging of ink and forming of dots. In addition, the printing apparatus 1 is provided with a control section 40 for controlling each of the mechanisms described above. The control section 40 is connected to the carriage 60 through a flexible cable 44.

The carriage 60 is provided with a holder 50 and a print head. The holder 50 is configured such that it is possible to mount a plurality of ink cartridges 10 therein, and the ink cartridges 10 which are mounted in the holder 50 are lined up in the Y axis direction. The ink cartridges 10 have levers 11 which are formed so as to be able to elastically change shape. In the present embodiment, it is possible to independently mount four of the ink cartridges 10 in the holder 50, and for example, four types of the ink cartridges 10 which are black, yellow, magenta, and cyan are mounted one at a time. The mounting direction of the ink cartridge 10 is the −Z direction (the vertical downward direction). Here, it may be possible to use a holder where it is possible to mount an arbitrary number of types of ink cartridges other than the above as the holder 50.

Figure 2:
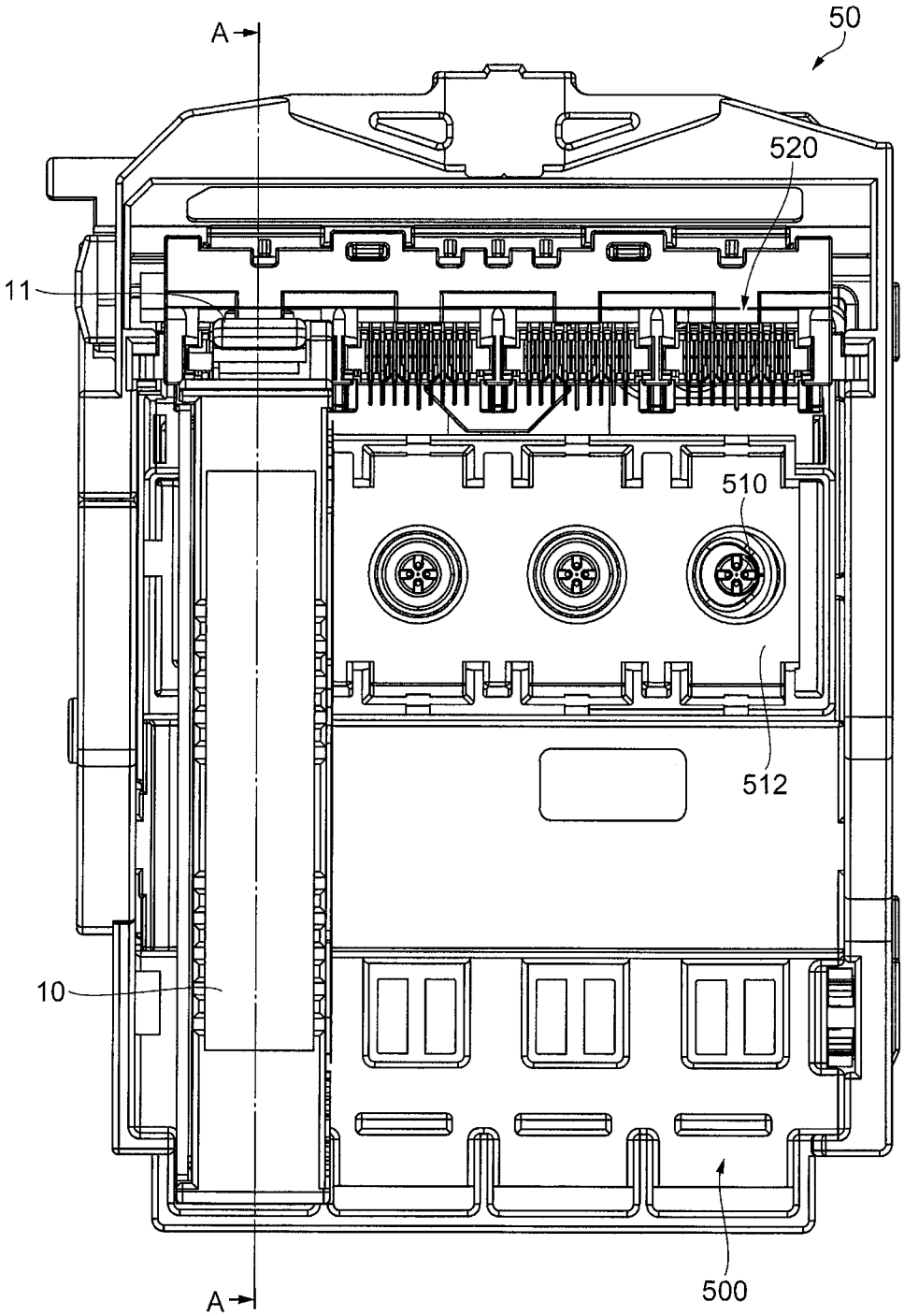
FIG. 2 is a planar diagram of a holder where an ink cartridge is mounted.

FIG. 2 is a planar diagram of the holder 50 where the ink cartridge 10 is mounted. For ease of description, FIG. 2 shows a state where one of the ink cartridges 10 is mounted in the holder 50. The holder 50 has four slots 500 where it is possible to mount one each of the ink cartridges 10. Ink supply needles 510 are provided in each of the slots 500 of the holder 50. The ink in the inner portion of the ink cartridge 10 is supplied to the print head through the ink supply needles 510. Elastic members 512 for sealing ink supply ports (which will be described later) of the ink cartridges 10 are provided in the periphery of the ink supply needles 510 such that ink does not leak out to the outside. In addition, four contact point mechanisms 520 (FIG. 2 shows three of the contact point mechanisms 520) are installed in the holder 50 to correspond to the number (four) of the ink cartridges 10 which are mounted. It is possible for the user to remove the ink cartridge 10 from the holder 50 by operating the lever 11 of the ink cartridge 10.

Returning to FIG. 1, the printing apparatus 1 has a detection apparatus 90 which is used for detecting the remaining state of the ink which is contained in the ink cartridges 10. The detection apparatus 90 has a light emitting element 92 and a light receiving element 94, and the light emitting element 92 and the light receiving element 94 are arranged so as to be lined up in parallel with the main scanning direction (the Y axis direction) where the carriage 60 moves.

Configuration of Cartridge

Next, the configuration of the ink cartridge 10 will be described.

Figure 3:
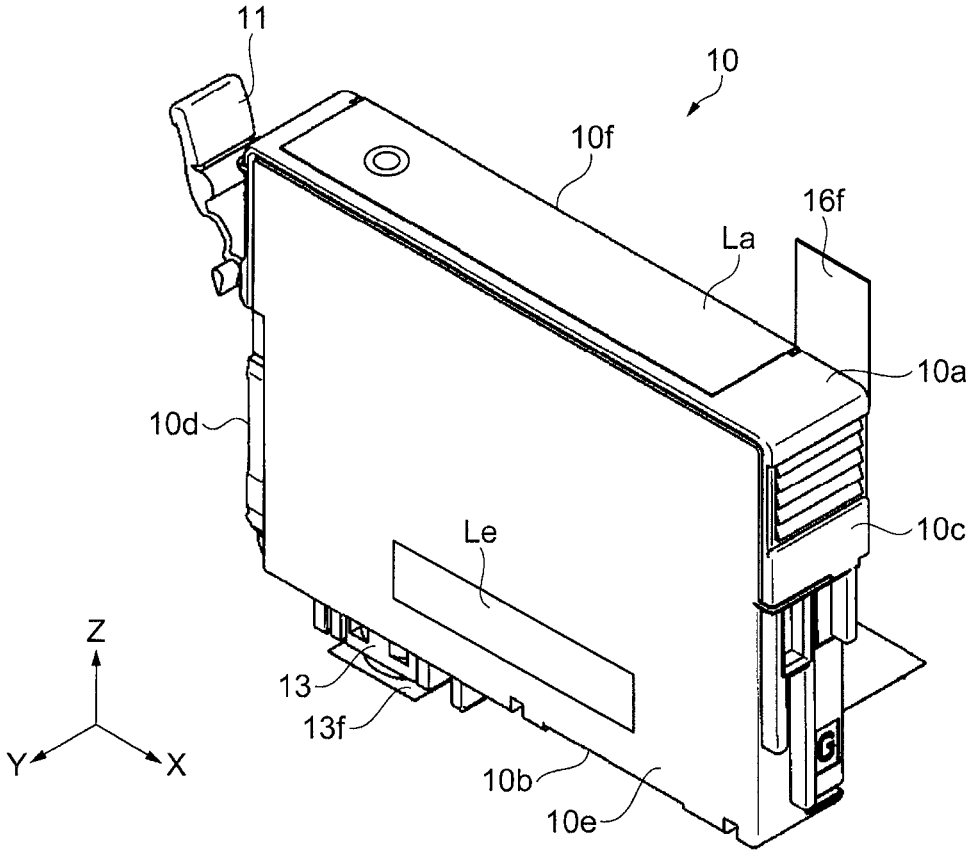
FIG. 3 is a perspective diagram of the external appearance of the ink cartridge.
Figure 4:
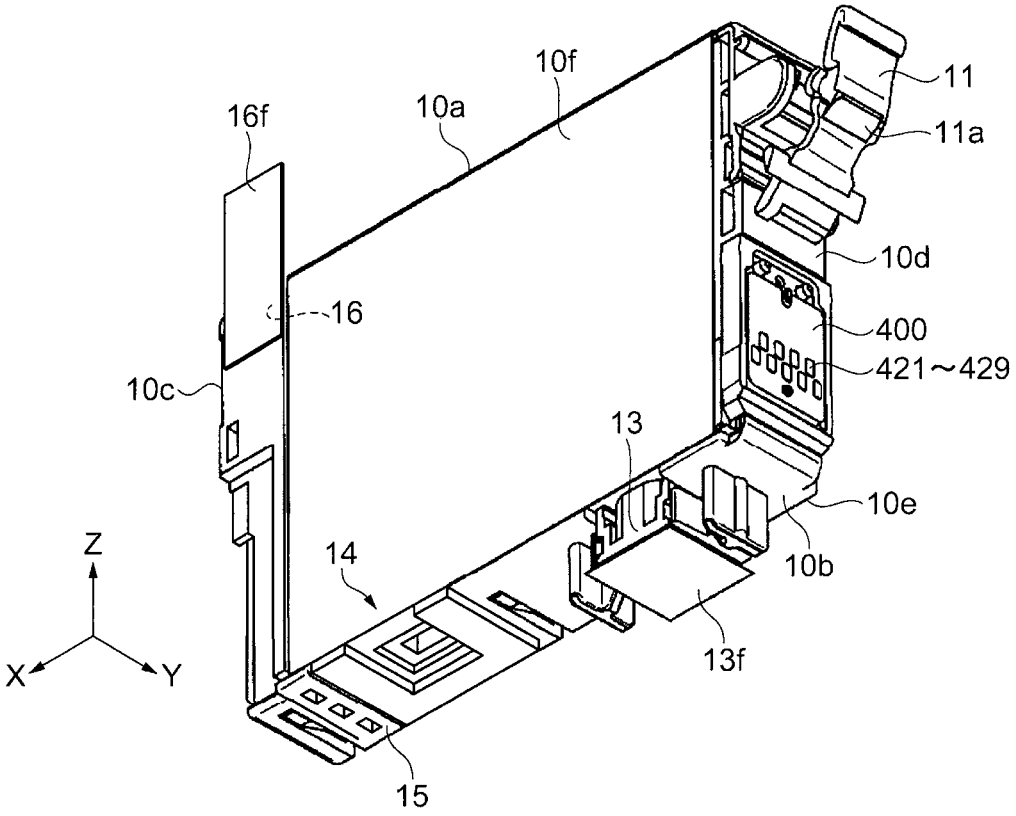
FIG. 4 is a perspective diagram of the external appearance of the ink cartridge which is viewed from the opposite direction.

FIG. 3 is a perspective diagram of the external appearance of the ink cartridge 10. FIG. 4 is a perspective diagram of the external appearance of the ink cartridge 10 which is viewed from the opposite direction to FIG. 3. As shown in FIG. 3 and FIG. 4, the ink cartridge 10 has a substantially rectangular shape and has a surface 10*a* at the Z direction side, a surface 10*b* (a third surface) at the −Z direction side, a surface 10*c* (a second surface) at the X direction side, a surface 10*d* (a first surface) at the −X direction side, a surface 10*e* at the Y direction side, and a surface 10*f* at the −Y direction side. Below, for convenience of description, the surface 10*a* is also referred to as the upper surface, the surface 10*b* as the bottom surface, the surface 10*c* as the right side surface, the surface 10*d* as the left side surface, the surface 10*e* as the front surface, and the surface 10*f* as the rear surface. In addition, the sides with the surfaces 10*a* to 10*f* are respectively referred to as the upper surface side, the bottom surface side, the right surface side, the left surface side, the front surface side, and the rear surface side.

An ink supply port 13 where an opening section for supplying ink to the printing apparatus 1 is formed is provided in the bottom surface 10*b*. The opening section of the ink supply port 13 is sealed by a sealing film 13*f* immediately after the ink cartridge 10 is manufactured. The sealing film 13*f* is configured so as to be broken by the ink supply needle 510 of the holder 50 when the ink cartridge 10 is mounted in the holder 50 of the printing apparatus 1. In addition, a prism unit 14, which is provided with a prism which is a detection section which is used for optically detecting the remaining state of ink which is contained in the ink cartridge 10, and an abutting section 15 are provided in the bottom surface 10*b*. Here, the details of the prism unit 14 and the abutting section 15 will be described later.

The lever 11 (the pressing section) is provided in the left side surface 10*d*. A protrusion 11*a* is formed on the lever 11. The ink cartridge 10 is fixed with regard to the holder 50 by the protrusion 11*a* engaging with a concave section 53 (refer to FIG. 10), which is formed in the holder 50, when the ink cartridge 10 is mounted in the holder 50. In addition, a circuit board 400 is provided in the downward direction of the lever 11 in the diagram. A plurality of terminals (cartridge side terminals) 421 to 429 are provided in the circuit board 400 and the terminals are electrically connected to the printing apparatus 1 through a contact point mechanism 520 (refer to FIG. 2) which is provided in the holder 50. A rewritable non-volatile memory such as an EEPROM (Electronically Erasable and Programmable Read Only Memory) is provided in the circuit board 400 and information which relates to the ink including information on the ink consumption amount of the printing apparatus 1 is recorded therein. Here, the details of the circuit board 400 will be described later.

An air vent hole 16 for introducing air into the inner portion of the ink cartridge 10 is provided in the rear surface 10*f*. The air vent hole 16 is sealed by a sealing film 16*f* immediately after the ink cartridge 10 is manufactured. After peeling off the sealing film 16*f*, the user mounts the ink cartridge 10 in the holder 50. As shown in FIG. 3 and FIG. 4, a portion of the sealing film 16*f* pops out from the upper surface 10*a* in the upward direction in the diagrams. Due to the popping out, it is possible for the user to be easily reminded not to forget to peel the sealing film 16*f*. That is, due to the popping out of the sealing film 16*f*, it is possible to prevent forgetting of the peeling of the sealing film 16*f*.

A label La and a label Le which indicate the contents of the ink cartridge 10 are attached to the upper surface 10*a* and the front surface 10*e* (or the rear surface 10*f*). For example, it is possible to clearly show individual information for each of the ink cartridges 10 such as ink color ("cyan" in the example of FIG. 3) or the like of the ink cartridge 10 in the label La of the upper surface 10*a*. On the other hand, it is possible to clearly show, for example, the common information for each of the ink cartridges 10 such as the compatible models or the like of the ink cartridge 10 in the label Le of the front surface 10*e* (or rear surface 100. By attaching the label La which clearly shows individual information to the upper surface 10*a*, it is possible for the user to identify at a glance the type (the ink color or the like) of the ink cartridge 10 from above the ink cartridge 10 when replacing the ink cartridge 10 which is mounted. In addition, by attaching the label Le which clearly shows the common information to the front surface 10*e* (or the rear surface 10*f*), the label Le is a common component in each of the ink cartridges 10 and it is possible for this to lead to the suppression of the manufacturing costs.

Inner Structure of Ink Cartridge

Next, the inner structure of the ink cartridge 10 will be described.

Figure 5:
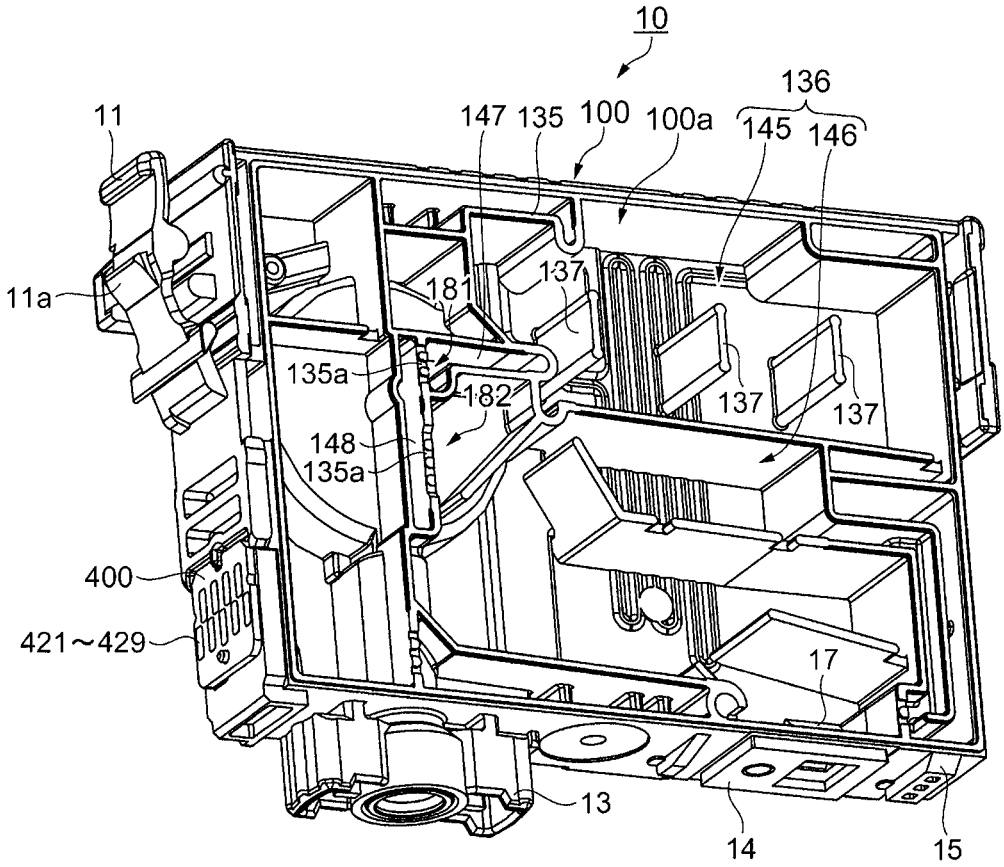
FIG. 5 is a front surface perspective diagram illustrating an inner structure of the ink cartridge.
Figure 6:
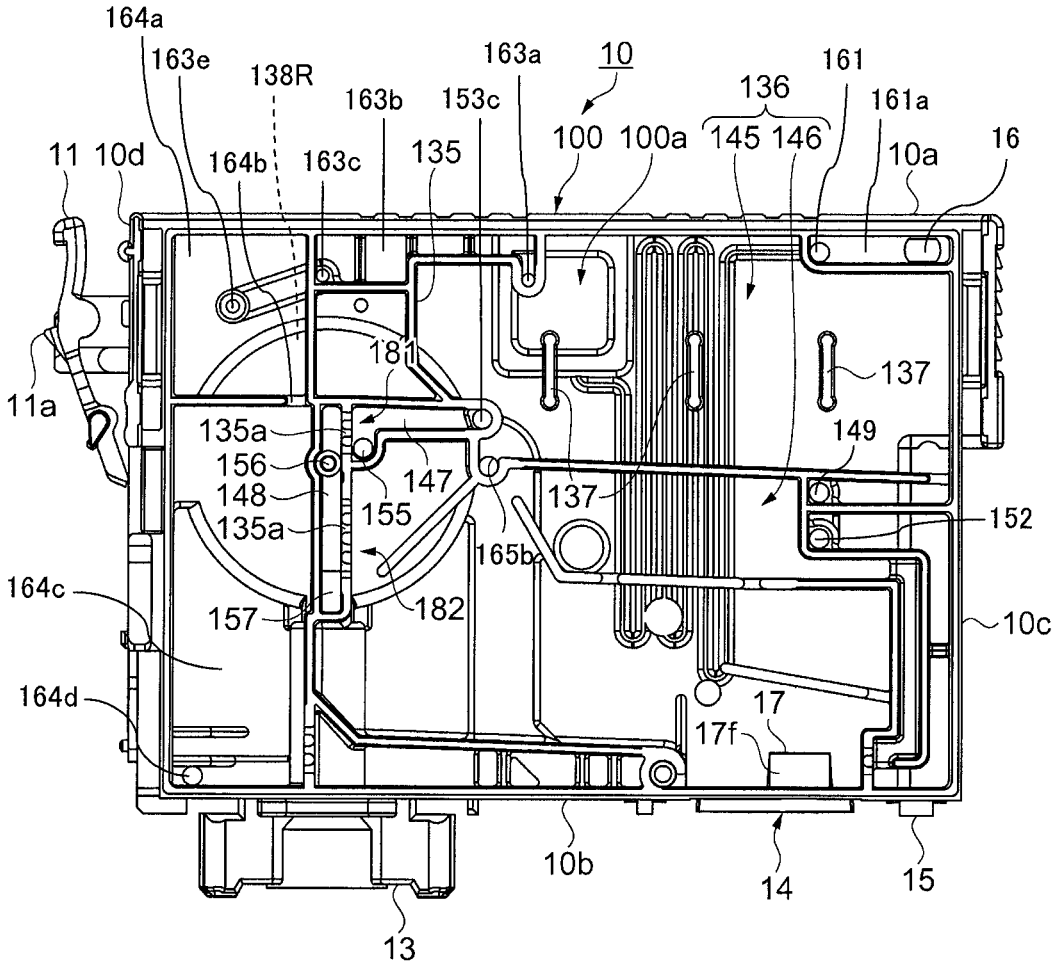
FIG. 6 is a front surface diagram illustrating the inner structure of the ink cartridge.
Figure 7:
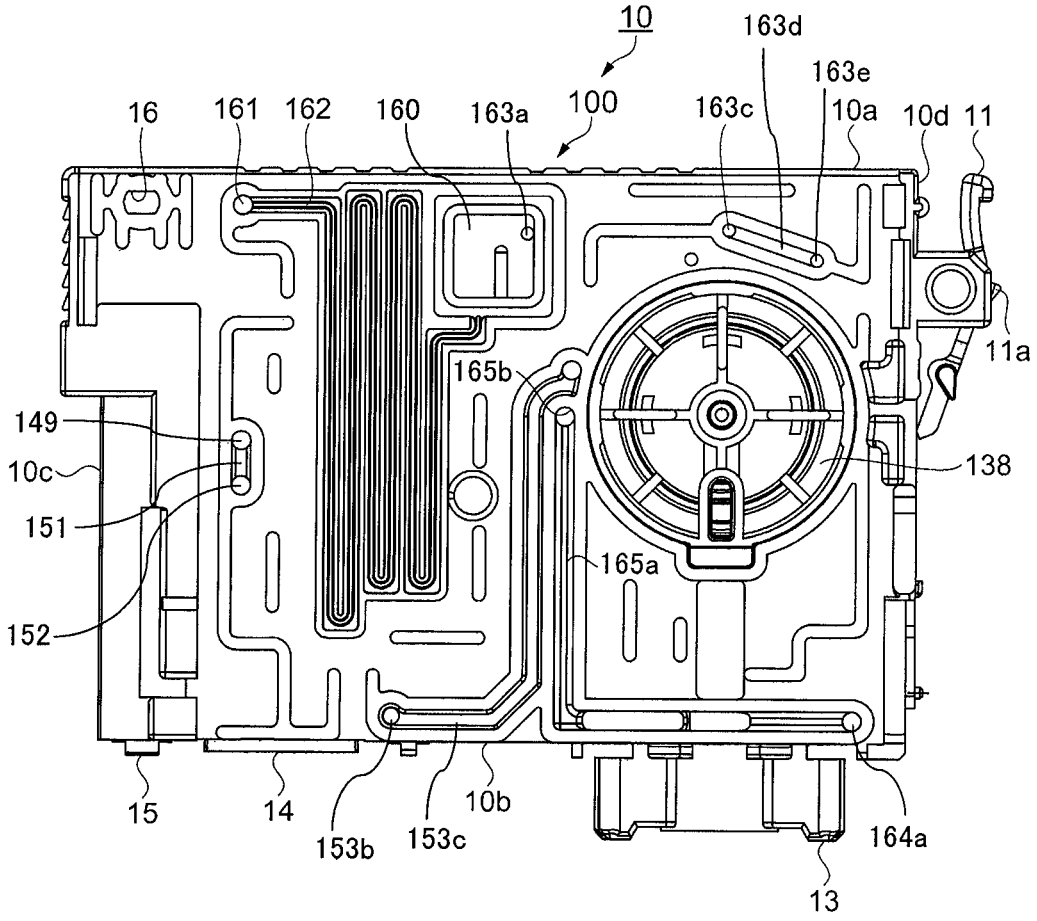
FIG. 7 is a rear surface diagram illustrating the inner structure of the ink cartridge.
Figure 8:
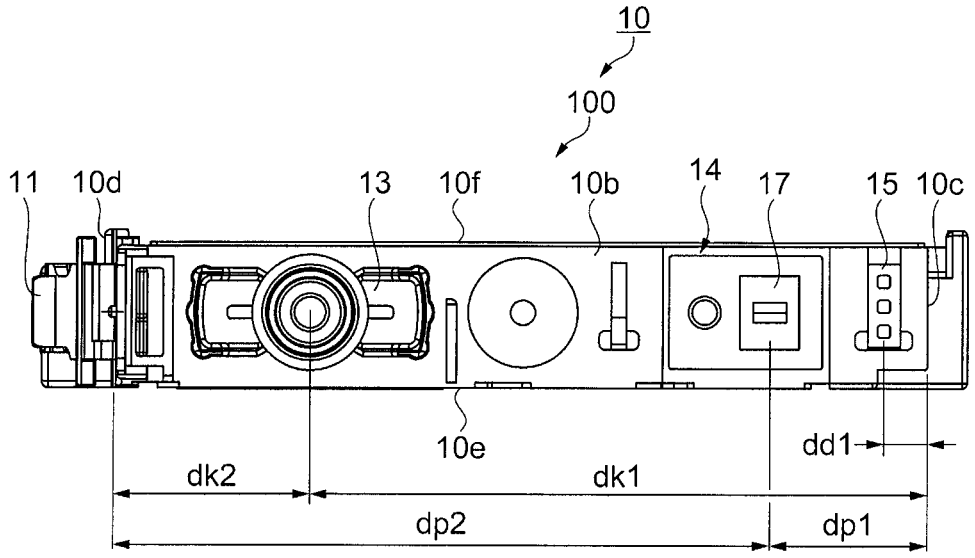
FIG. 8 is a bottom surface diagram illustrating the inner portion of the ink cartridge.

FIG. 5 is a front surface perspective diagram illustrating an inner structure of the ink cartridge 10. FIG. 6 is a front surface diagram illustrating the inner structure of the ink cartridge 10. FIG. 7 is a rear surface diagram illustrating the inner structure of the ink cartridge 10. FIG. 8 is a bottom surface diagram illustrating the inner structure of the ink cartridge 10. As shown in FIG. 5 and FIG. 6, the ink cartridge 10 has a cartridge body 100 with a flat rectangular box shape where the front surface side is opened. A front film (which is not shown in the diagram) is attached to the front surface side of the cartridge body 100 so as to cover substantially the entire surface of an opening section 100*a*. Furthermore, in order to conceal the opening section 100*a* from the outside (the front surface side) of the front film, a lid (which is not shown in the diagram) is attached so as to be able to be attached and detached. In addition, a rear film (which is not shown in the diagram), which is formed of a material which is able to be adhered using heat, is attached to the rear surface and the upper surface of the cartridge body 100 so as to cover substantially the entire surface of the rear surface and the upper surface. The front film and the rear film are both formed of a material which is able to be adhered using heat and are adhered to the cartridge body 100 by heating.

As shown in FIG. 5 and FIG. 6, a plurality of ribs 135 are provided from the bottom surface of the opening section 100*a* in the thickness direction of the cartridge body 100 (the direction to the front surface side and the rear surface side) inside the opening section 100*a* of the cartridge body 100. A plurality of chambers, such as an ink containing chamber 136, and flow paths (or passages) are formed and partitioned by the ribs 135. In addition, as shown in FIG. 7, a differential pressure valve containing chamber with a circular concave shape which contains a differential pressure valve 138 and a gas-liquid separation chamber 160 with a rectangular concave shape are formed at the rear surface side of the cartridge body 100.

As shown in FIG. 5 and FIG. 6, the ink containing chamber 136 which is separated into an upper portion ink containing chamber 145 and a lower portion ink containing chamber 146 is formed and partitioned by the ribs 135 at the front surface side of the cartridge body 100. In addition, a buffer chamber 147 with a substantially rectangular shape is formed and partitioned so as to be positioned between the upper portion ink containing chamber 145 and the lower portion ink containing chamber 146. Furthermore, a vertically long outlet port flow path 148 is formed and partitioned so as to be positioned between the buffer chamber 147 and the lower portion ink containing chamber 146. A through hole 149 is formed in the thickness direction of the cartridge body 100 at a position which is the lowest portion of the upper portion ink containing chamber 145 in the diagram. As shown in FIG. 7, the through hole 149 is linked to a connecting flow path 151 which is formed at the rear surface side of the cartridge body 100. The connecting flow path 151 is linked to a through hole 152 which is formed in the lower portion ink containing chamber 146. The ink flows from the upper portion ink containing chamber 145 to the lower portion ink containing chamber 146 through the through hole 149, the connecting flow path 151, and the through hole 152. As shown in FIG. 6, a through hole 153*a* is formed in the bottom portion of the lower portion ink containing chamber 145. The ink which flows out from the through hole 153*a* passes through a connecting flow path 153*b* shown in FIG. 7 and a through hole 153*d* shown in FIG. 6 in this order and flows to the buffer chamber 147.

As shown in FIG. 6, a through hole 155 is formed in the downward direction in the buffer chamber 147 in the diagram.

The through hole 155 is connected to a space which is formed between a circular shaped wall 138R which is shown in FIG. 6 and the differential pressure valve 138 shown in FIG. 7. The space is linked to a valve hole 156 which is formed at the top of the inside of the outlet port flow path 148. The valve hole 156 is opened and closed by the differential pressure valve 138. The ink flows in the outlet port flow path 148 when the differential pressure valve 138 opens the valve hole 156. A through hole 157 is formed at the bottom of the inside of the outlet port flow path 148. The ink flows from the outlet port flow path 148 to the ink supply port 13 through the through hole 157. In addition, as shown in FIG. 7, a through hole 161 is formed in the vicinity of the air vent hole 16 in the rear surface side of the cartridge body 100. As shown in FIG. 6, the through hole 161 is linked to the air vent hole 16 through a connecting path 161*a* which is formed in the front surface side of the cartridge body 100. In addition, as shown in FIG. 7, the through hole 161 is connected with a narrow groove 162 with a meandering shape which is linked to the gas-liquid separation chamber. A linking path 163, the air vent hole 16, and the narrow groove 162 configure a portion of an air flow path which introduces air which is taken in from the air vent hole 16 to the ink containing chamber 136. The air which is taken in from the air vent hole 16 is guided to the upper portion ink containing chamber 145 by passing through the connecting path 161*a* (FIG. 6), the through hole 161, the narrow groove 162 (FIG. 7), a through hole 163*a*, a connecting path 163*b* (FIG. 6), a through hole 163*c*, a connecting path

163*d* (FIG. 7), a through hole 163*e*, a connecting chamber 164*a* (FIG. 6), a passage 164*b*, a connecting chamber 164*c*, a through hole 164*d*, a connecting path 165*a*, and a through hole 165*b* in this order. Here, the ink flow path, the air flow path, the ink containing chamber 136, and the like are each formed by setting the front film and rear film, which are respectively attached to the front surface side and the rear surface side of the cartridge body 100, as a portion of a wall surface.

As shown in FIG. 5 and FIG. 6, a plurality (three in the present embodiment) of ribs 137 are provided from the bottom surface of the opening section 100*a* in the upper portion ink containing chamber 145. The ribs 137 are ribs for suppressing warping of the front film which covers the opening section 100*a*. Therefore, the top surfaces of both end portions in the up and down direction of each of the ribs 137 in the drawing are processed so that the widths are wider and rounder than the portion other than the end portions when viewed from the front surface side. Here, in FIG. 5 and FIG. 6, at the top surface in the ribs 135 where the front film is attached, there is a portion marked by a thin line and a portion marked by a thick line. The top surface of the thin line portion represents that the width is wider than the top surface of the thick line portion in a case of viewing from the front surface side. Specifically, in a case of viewing from the front surface side, the width is wider mainly in the top surface of the portion where the ribs 135 intersect with each other, the top surface of the portion where the ribs 135 have a curved shape, and the like than the top surface of the other portions of the ribs 135.

The effect of providing the plurality of ribs 137 and the effect of widening the width of the top surface of the ribs 135 are as follows. In a case where an impact is applied, for example, due to vibration, dropping, or the like with regard to the ink cartridge 10, the front film which covers the opening section 100*a* may be bent. In a case where the area of the bending is large, a force is applied to the ribs 135 where the front film is adhered by heating, and as a result, there is a concern that the front film may peel off from the ribs 135 and leakage of ink may occur. In contrast to this, it is possible to effectively support the front film without breaking and suppress the bending by providing the plurality of ribs 137 which are processed so that the widths of both end sections are wide and round. In addition, in a case where the front film is bent, force is easily applied to the top surface of the portion where the ribs 135 intersect with each other and the top surface of the portion where the ribs 135 have a curved shape than to the top surface of the portions of the other ribs 135. As a result, in the top surface of the portion where the ribs 135 intersect and the top surface of the portion with a curved shape, it is possible to prevent the front film from peeling off from the ribs 135 by widening the widths and attaching the front film.

Next, the method of injecting ink from the outside of the cartridge body 100 into the inside of the ink containing chamber 136 will be described. Here, an ink injection hole for the exclusive injection of ink is not provided in the ink cartridge 10 of the present embodiment. As a result, in a case where the ink is initially injected into the inside of the ink containing chamber 136, and a case where the ink is injected again in order to refill the inside of the ink containing chamber 136 with ink, the ink supply port 13 is also used for ink injection.

In a case where the ink is initially injected, when the front film is attached to the front surface of the cartridge body 100, an interval is formed between the top surface of the ribs 135 which enclose the outlet port flow path 148 and the front film. Specifically, as shown in FIG. 5 and FIG. 6, a plurality of convex sections 135*a* are formed at predetermined intervals in the top surfaces of the ribs 135 which divide the outlet port flow path 148 and the buffer chamber 147. In addition, a plurality of convex sections 135*a* are also formed at predetermined intervals in the top surfaces of the ribs 135 which divide the outlet port flow path 148 and the lower portion ink containing chamber 146. Due to this, the front film is not attached between each of the convex sections 135*a*, and intervals which permit the flow of ink between the ribs 135 and the front film are formed. As a result, according to the intervals, a bypass flow path 181 and a bypass flow path 182 are formed so as to pass through the ribs 135 from the outlet port flow path 148 and bypass the differential pressure valve 138. The bypass flow path 181 permits ink to flow from the outlet port flow path 148 into the buffer chamber 147. The bypass flow path 182 permits ink to flow from the outlet port flow path 148 into the lower portion ink containing chamber 146. Then, the ink is injected into the ink cartridge 10 through the bypass flow paths 181 and 182. When the injection of the ink into the ink cartridge 10 is completed, the bypass flow paths 181 and 182 are closed off by press heating each of the convex sections 135*a* on the ribs 135 from above the front film using a jig such as a heating iron.

On the other hand, in a case where the ink is injected again, a portion, where the bypass flow paths 181 and 182 which have been closed off and the front film are attached, is press heated from above the front film using a jig such as a heating iron. Then, the front film is peeled so as to be lifted from the top surface of the ribs 135 by melting the attached portion. Due to this, intervals are formed between the ribs 135 and the front film and the bypass flow paths 181 and 182 are formed again. Then, in the same manner as a case where ink is initially injected, the bypass flow paths 181 and 182 are closed off after the ink is injected into the ink cartridge 10.

In the method of injecting the ink described above, the ink is injected from the outlet port flow path 148 into the buffer chamber 147 and the lower portion ink containing chamber 146 through the respective bypass flow paths 181 and 182. However, in a case where a small amount of ink is injected into each of the buffer chamber 147 and the lower portion ink containing chamber 146, there is a problem in that air bubbles remain in the buffer chamber 147. As a result, in a case where the ink to be injected is a small amount, only the bypass flow path 181 is formed and the bypass flow path 182 is set to a state of being closed off. Then, ink is injected only into the buffer chamber 147 through the bypass flow path 181. Due to this, it is possible to take action against the problem of bubbles remaining in the buffer chamber 147. On the other hand, in a case where a large amount of ink is injected, both of the bypass flow paths 181 and 182 are formed and ink is respectively injected into the buffer chamber 147 and the lower portion ink containing chamber 146. Due to this, it is possible to reduce the time which is necessary for the ink injection.

Next, the inner structure of the ink cartridge 10 will be described based on the bottom surface diagram which is shown in FIG. 8.

As shown in FIG. 8, the ink supply port 13, the prism unit 14, and the abutting section 15 are provided in the bottom surface 10*b* of the cartridge body 100. The prism unit 14 is formed using a transparent resin (for example, polypropylene). The prism unit 14 has a prism 17 which is a detection section which is used for detecting the remaining state of the ink. The prism 17 has a right-angled isosceles triangular prism shape as shown in FIG. 5 and FIG. 6, and a reflecting surface 17*f* of the prism 17 is disposed so as to be positioned inside the lower portion ink containing chamber 146.

Figure 9A:
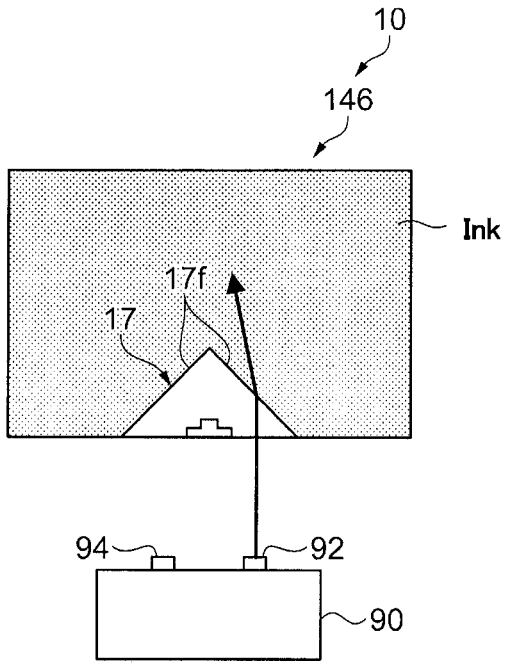
FIGS. 9A and 9B are diagrams for describing detection of an ink remaining state using a prism.
Figure 9B:
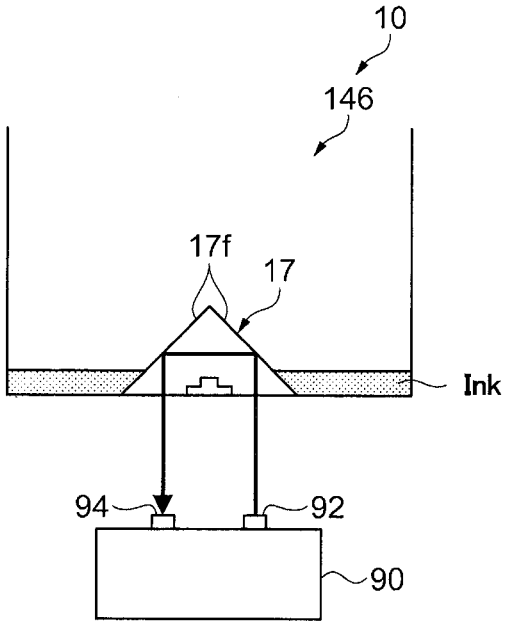

FIGS. 9A and 9B are diagrams for describing detection of the ink remaining state using the prism 17. As shown in FIG.

9A and FIG. 9B, the light which is irradiated from the light emitting element 92 is incident to the prism 17. In the prism 17, the reflecting state of the light is different according to the refractive index of the fluid which is in contact with the reflecting surface 17*f*. In FIG. 9A, since an ink IK inside the lower portion ink containing chamber 146 is present to the extent of coming into contact with the entire surface of the reflecting surface 17*f*, the light which is irradiated from the light emitting element 92 passes through the reflecting surface 17*f* and is absorbed inside the ink IK. On the other hand, in FIG. 9B, since the remaining amount of the ink IK inside the lower portion ink containing chamber 146 is low and the reflecting surface 17*f* is in contact with the air, the greater portion of the light which is irradiated from the light emitting element 92 is reflected by the reflecting surface 17*f* of the prism 17 and is incident to the light receiving element 94. Due to this, it is possible to detect the state where the ink remaining amount is reduced by measuring the light which is incident to the light receiving element 94.

Returning to FIG. 8, the abutting section 15 has a convex shape which protrudes from the bottom surface 10*b* in the mounting direction of the ink cartridge 10 as shown in FIG. 5 and FIG. 6. When the user mounts the ink cartridge 10 in the holder 50, the ink cartridge 10 is pushed forward in the mounting direction, and finally, the abutting section 15 with the convex shape abuts against the holder 50 and enters the mounted state. In addition, due to the abutting section 15 having a convex shape, it is possible to avoid a reduction in the volumetric efficiency of the lower portion ink containing chamber 146 of the cartridge body 100. Furthermore, it is possible to easily provide the abutting section 15 in the bottom surface 10*b*. In addition, the abutting section 15 is configured by, for example, a material which absorbs light such as polystyrene which is colored black. Due to this, in FIG. 9A and FIG. 9B, it is possible to suppress the light which is irradiated from the light emitting element 92 from being reflected by the abutting section 15 and incident to the light receiving element 94, and it is possible to improve precision of the detection of the remaining state of the ink.

FIG. 8 shows the positional relationships of each of the ink supply port 13, the prism 17, and the abutting section 15 in the bottom surface 10*b*. A distance dp1 from the center position of the prism 17 to the edge (the second end section) of the right side surface 10*c* is shorter than a distance dp2 from the center position of the prism 17 to the edge (the first end section) of the left side surface 10*d*. That is, the prism 17 is arranged at the right side surface 10*c* side and not at the left side surface 10*d* side. In addition, a distance dk1 from the center position of the ink supply port 13 to the edge of the right side surface 10*c* is longer than a distance dk2 from the center position of the ink supply port 13 to the edge of the left side surface 10*d*. That is, the ink supply port 13 is arranged at the left side surface 10*d* side and not at the right side surface 10*c* side. A distance dd1 from the center position of the abutting section 15 to the edge of the right side surface 10*c* is shorter than the distance dp1 from the center position of the prism 17 to the edge of the right side surface 10*c*. That is, the abutting section 15 is arranged between the prism 17 and the right side surface 10*c* side and arranged more to the right side surface 10*c* side than the prism 17.

Mounted State of Ink Cartridge 10

Next, the mounted state of the ink cartridge 10 to the holder 50 will be described.

Figure 10:
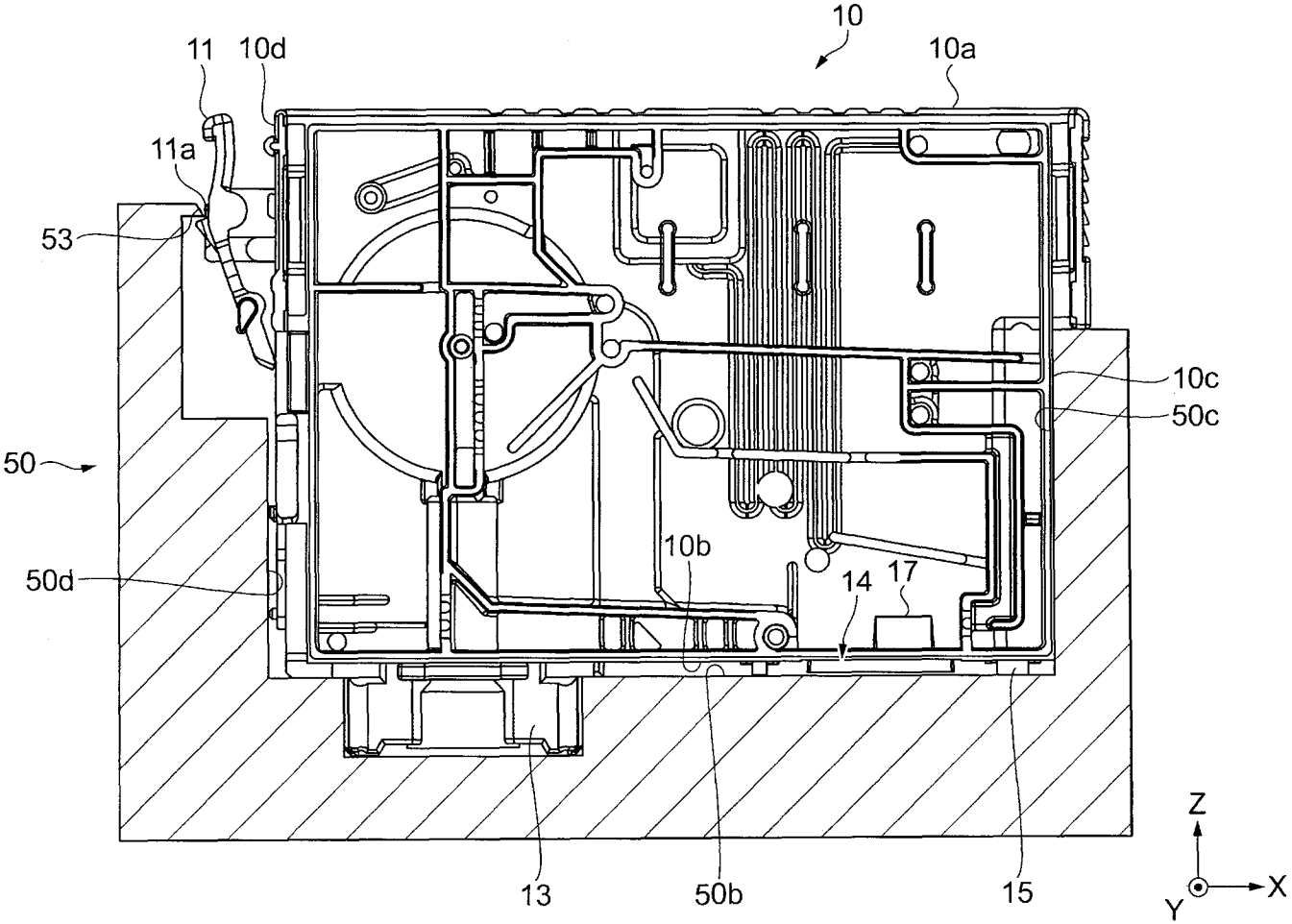
FIG. 10 is a cross sectional diagram illustrating a state where the ink cartridge is mounted in the holder.

FIG. 10 is a cross sectional diagram illustrating a state where the ink cartridge 10 is mounted in the holder 50. FIG. 10 schematically shows a cross section A-A of the ink cartridge 10 and the holder 50 shown in FIG. 2. As shown in FIG. 10, the ink cartridge 10 is fixed in the holder 50 by engaging the protrusion 11*a* which is formed in the lever 11 of the ink cartridge 10 with the concave section 53 which is formed in a left side surface 50*d* of the holder 50. Then, the ink cartridge 10 is pressed in the X direction using the elastic changing of the shape of the lever 11, and for example, the surface of the X direction side of the ink supply port 13 of the ink cartridge 10 abuts against the holder 50. In addition, in the mounted state, the abutting section 15 and the ink supply port 13, which are provided in the bottom surface 10*b* of the ink cartridge 10, abut against a bottom surface 50*b* of the holder 50. Then, the abutting section 15 and the ink supply port 13 of the ink cartridge 10 each receive an external force from the bottom surface 50*b* of the holder 50 in the Z direction. At this time, as described above, since the abutting section 15 is arranged at the right side surface 10*c* side and the ink supply port 13 is arranged at the left side surface 10*d* side, the abutting section 15 and the ink supply port 13 are supported in a state which is stabilized from the bottom surface 50*b* of the holder 50 which abuts against the abutting section 15 and the ink supply port 13.

FIG. 10 shows a case where the external dimensions of the ink cartridge 10 and the holder 50 are the regular dimensions and, in addition, where the respective positions for the providing of the lever 11, the protrusion 11*a*, the ink supply port 13, the abutting section 15, and the like of the ink cartridge 10 are also correct. However, in practice, individual differences may occur in the external dimensions of the ink cartridge 10 or the positions for the providing of each section of the ink cartridge 10. In this case, surplus freedom or the like is generated between the ink cartridge 10 which is mounted and the holder 50 and the ink cartridge 10 is rotated inside the holder 50, and there is a possibility that the mounting position of the ink cartridge 10 into the holder 50 will deviate with regard to the defined position.

Figure 11A:
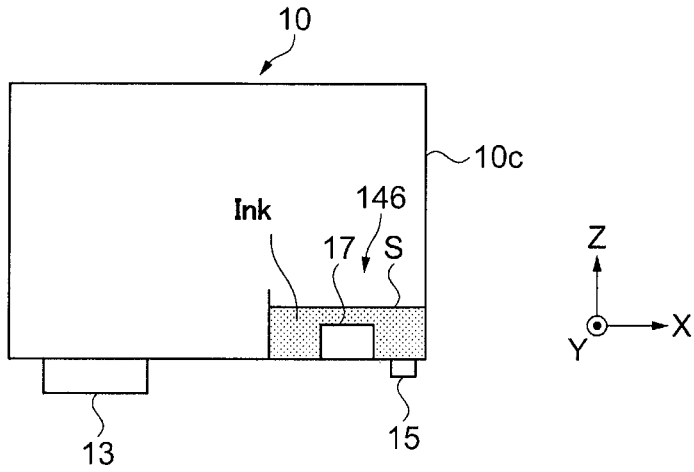
FIGS. 11A to 11C are diagrams for describing the relationship of the rotation of the ink cartridges and the ink remaining state.

FIG. 11 is a diagram for describing the relationship of the rotation of the ink cartridges 10 and the ink remaining state. FIG. 11A shows the correct mounting state where the ink cartridges 10 do not rotate inside the holder 50. In FIG. 11A, the remaining amount of the ink IK in the lower portion ink containing chamber 146 is in a low state, but it is determined that printing is possible in the printing apparatus 1 since a surface S of the ink IK exists at a position which is higher than the prism 17.

Figure 11B:
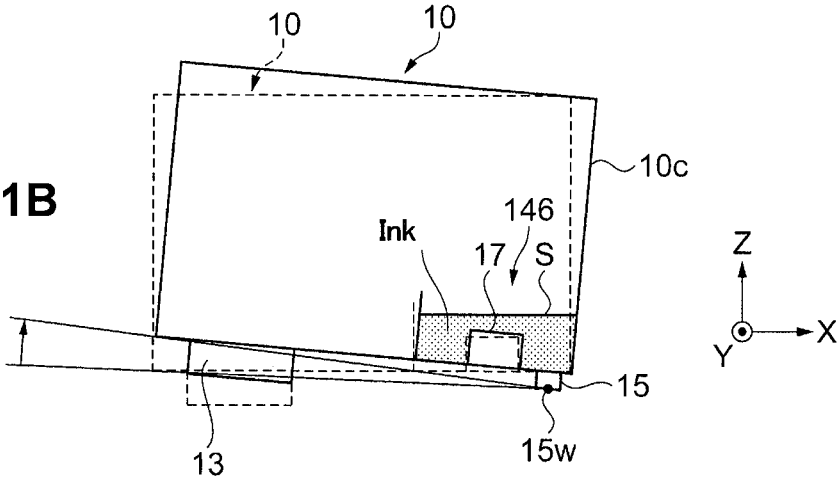

FIG. 11B shows a mounting state where the ink cartridge 10 is slightly rotated in the clockwise direction inside the holder 50. Here, the ink cartridge 10 of the broken line in FIG. 11B shows the ink cartridge 10 in the correct mounting state of FIG. 11A. In FIG. 11B, the ink cartridge 10 which is described above is pressed in the X direction. As a result, when the ink cartridge 10 is rotated in the holder 50, the rotation is clockwise with a center of rotation 15*w* of the abutting section 15 as the axis. Due to this rotation, the ink IK is inclined toward the X direction inside the lower portion ink containing chamber 146. In this case, the surface S of the ink IK is closer to the prism 17 than in FIG. 11A, but since the surface S of the ink IK exists at a position which is still higher than the prism 17, it is determined that printing is possible in the printing apparatus 1.

Figure 11C:
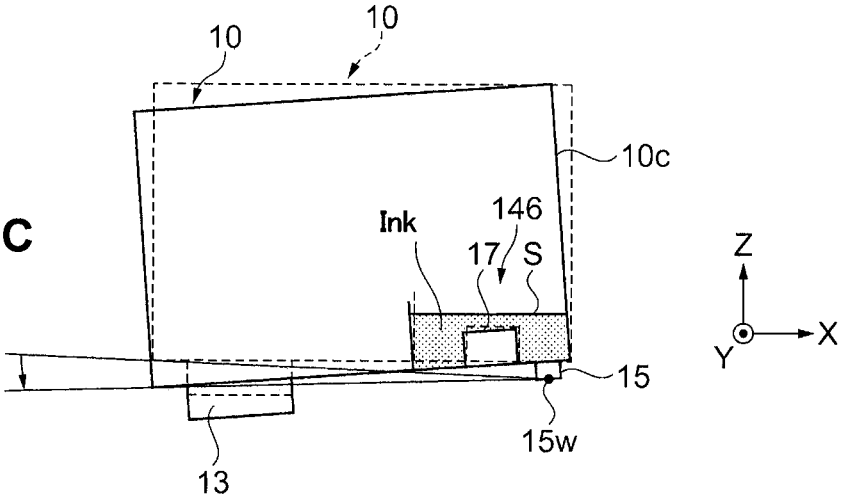

FIG. 11C shows a mounted state where the ink cartridge 10 is slightly rotated in the counterclockwise direction inside the holder 50. Here, the ink cartridge 10 of the broken line in FIG. 11C shows the ink cartridge 10 in the correct mounting state of FIG. 11A. In FIG. 11C, when the ink cartridge 10 is rotated inside the holder 50, the rotation is counterclockwise with the center of rotation 15*w* of the abutting section 15 as the axis. Due to this rotation, the ink IK is inclined toward the −X direction inside the lower portion ink containing chamber 146. In this case, the surface S of the ink IK is closer to the prism 17 than in FIG. 11A, but since the surface S of the ink IK is present at a position which is still higher than the prism 17, it is determined that printing is possible in the printing apparatus 1.

Here, supposing a case where the prism 17 is arranged at the left side surface 10*d* side and not at the right side surface 10*c* side, since the prism 17 is positioned far from the center of rotation 15*w*, the amount of displacement in the vicinity of the prism 17 due to the rotation is large and the inclination of the ink IK inside the ink cartridge 10 which is the target of the detection by the prism 17 also becomes large. As a result, there is a possibility that it may be mistakenly determined that printing is not possible due to an insufficient ink remaining amount even though the ink remaining amount is of a level where printing is possible, or conversely, that it may be mistakenly determined that the insufficient ink remaining amount is sufficient and printing is possible even though the ink remaining amount is insufficient and printing is not possible.

In the present embodiment, as shown in FIGS. 11B and 11C, in a case where the ink cartridge 10 is rotated inside the holder 50 due to the individual differences in the ink cartridge 10, there is rotation with the center of rotation 15*w* of the abutting section 15 as an axis. At this time, since the prism 17 is positioned near to the center of rotation 15*w*, the amount of displacement in the vicinity of the prism 17 due to the rotation is small, and the inclination of the ink IK inside the lower portion ink containing chamber 146 which is the target of the detection also becomes small as shown in FIGS. 11B and 11C. Due to this, in a case where there are individual differences in the external dimensions of the ink cartridge 10 or the positions for providing each section of the ink cartridge 10, it is possible to suppress the adverse effects on the precision of the detection of the remaining state of the ink.

In addition, in FIG. 10, there is a state where the angle formed by the mounting direction (−Z direction) and the bottom surface 10*b* of the ink cartridge 10 is 90 degrees. In other words, the ink cartridge 10 is held by the holder 50 in a horizontal state. By the angle during the mounted state not exceeding 90 degrees, the abutting section 15 becomes the center of rotation when there are individual differences in the ink cartridge 10 and rotation occurs inside the holder 50.

Circuit Board 400

Figure 12A:
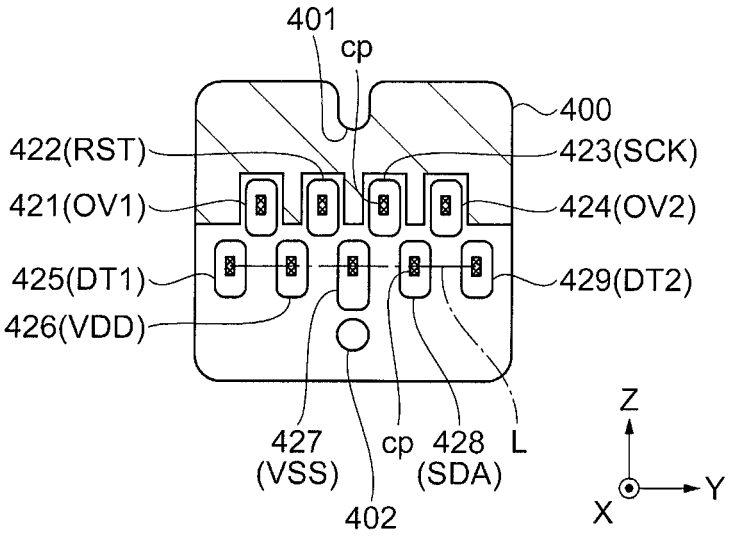
FIGS. 12A and 12B are explanatory diagrams of a circuit board.
Figure 12B:
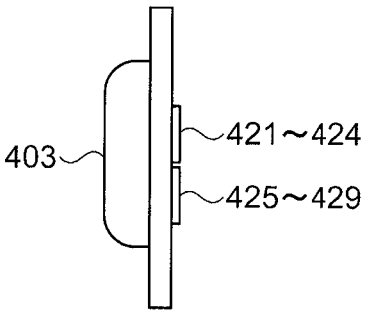

Next, the circuit board 400 which is provided in the left side surface 10*d* of the ink cartridge 10 will be described. FIGS. 12A and 12B are explanatory diagrams of the circuit board 400. FIG. 12A shows a configuration of a surface of the circuit board 400. FIG. 12B is a side surface diagram of the circuit board 400. The surface of the circuit board 400 is a surface which is exposed to the outside when the ink cartridge 10 is attached. Here, the circuit board 400 is pushed forward along with the ink cartridge 10 in the −Z direction and mounted in the holder 50.

As shown in FIG. 12A, a boss groove 401 is formed in the upper end section (the Z direction end section) of the circuit board 400 and a boss hole 402 is formed in the lower end section (the −Z direction end section) which is the end section of the mounting direction side of the circuit board 400. The circuit board 400 is provided with a terminal group which is formed of nine terminals (the cartridge side terminals) 421 to 429 which are arranged on the surface and a storage device 403. The storage device 403 which is a rewritable non-volatile memory which is arranged on the rear surface stores information which relates to the ink of the ink cartridge 10. The terminals 421 to 429 are formed in a substantially rectangular shape and arranged so as to form two rows which are substantially orthogonal to the Z axis. In the two rows, the first row which is positioned at the lower side (the −Z direction side) is referred to as the lower side row (the first terminal row) and the second row which is positioned at the upper side (the +Z direction side) is referred to as the upper side row (the second terminal row).

Each of the terminals 421 to 429 includes contact sections cp, which come into contact with apparatus side terminals (which will be described later) which correspond to the inside of the contact point mechanism 520 which is attached to the holder 50, in a central portion thereof. Each of the contact sections cp of the four terminals 421 to 424 which form the upper side row and each of the contact sections cp of the five terminals 425 to 429 which form the lower side row are arranged to be different from each other, that is, configured in a zigzag arrangement. The contact sections cp are arranged so as to form two rows which are substantially orthogonal to the Z axis. Out of the two rows, the first row which is positioned at the lower side (the −Z direction side) is referred to as the lower side row (the first contact section row), and the second row which is positioned at the upper side (the +Z direction side) is referred to as the upper side row (the second contact section row). The terminals 421 to 424 which form the upper side row and the terminals 425 to 429 which form the lower side row are arranged in to be different from each other and configured with a zigzag shaped arrangement such that the centers of each of the terminals are not lined up in the −Z direction which is the mounting direction. The terminal 427 which is a ground terminal is longer in the −Z direction (the mounting direction) than the other terminals of the circuit board 400.

Figure 13:
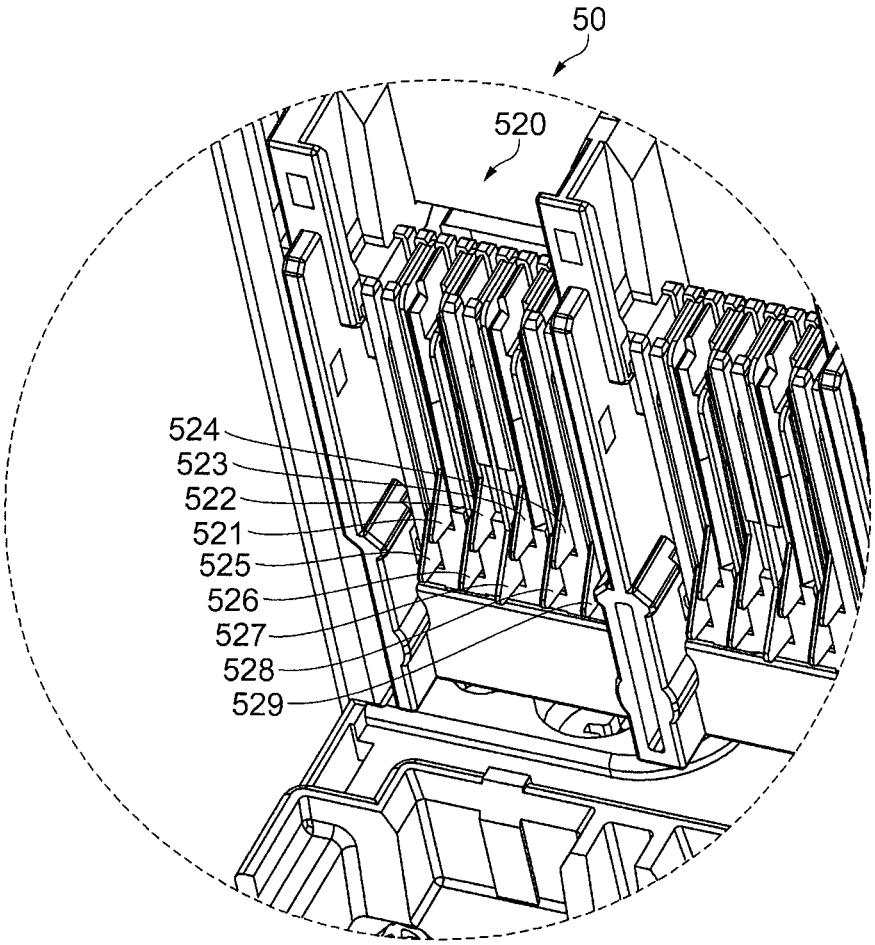
FIG. 13 is an enlarged perspective view of one contact point mechanism which is arranged inside the holder.
Figure 14:
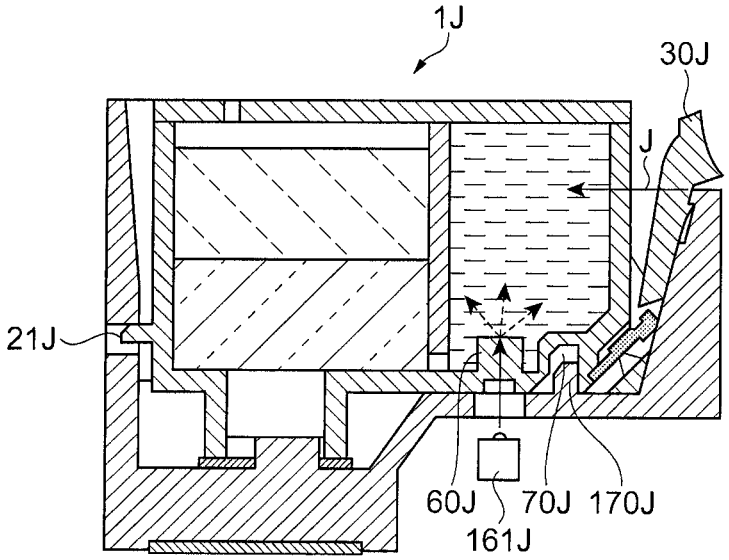
FIG. 14 is a cross sectional diagram illustrating a state where the ink cartridge is mounted in the prior art.

FIG. 13 is an enlarged perspective view of one contact point mechanism 520 which is arranged inside the holder 50 shown in FIG. 2. A plurality of apparatus side terminals 521 to 529 are provided in the contact point mechanism 520. Each of the apparatus side terminals 521 to 529 corresponds to the terminals 421 to 429 of the circuit board 400. Each of the apparatus side terminals 521 to 529 is configured by a member (an elastic member) with a spring property and has an elastic force which pushes back against the terminals 421 to 429 when the terminals 421 to 429 are pushed and attached thereto. In addition, an apparatus side terminal 527 which is the center of the lower side row in the diagram is the ground terminal and the protrusion height is larger than the other apparatus side terminals. Accordingly, when the ink cartridge 10 is mounted inside the holder 50, the ground terminal 527 comes into contact with the cartridge side terminals ahead of the other apparatus side terminals. In other words, inside the terminals 421 to 429 of the cartridge side, the ground terminal 427 comes into contact with the apparatus side terminals before the other terminals. In the circuit board 400 of the cartridge, a circuit and the storage device 403 are provided so as to be connected to at least a portion of the cartridge side terminals. When a high voltage is applied by accident to the cartridge side terminals, there is a possibility that a fault may occur in the circuit or the storage device. By the apparatus side ground terminal 527 being provided to protrude more than the other apparatus side terminals, it is possible to connect the ground terminals faster than the connection of the other terminals at the cartridge side and the holder side. As such, it is possible to reduce the occurrence of a fault in the circuit or the storage device.

In addition, as shown in FIG. 12, a coating film is formed in the portion which is indicated by the diagonal line in the diagram in the surface of the circuit board 400. The coating of the film is in a region excluding a region between the first terminal row which includes the first contact section row, that is, the terminal 421 to the terminal 424, and the end section (the lower end section, the end section of the −Z axis direction side) of the mounting direction side of the circuit board 400. A plurality of wirings which are formed by a conductor are arranged in the portion which is covered by the coating film. On the other hand, the region, which is between the first terminal row which includes the first contact section row, that is, the terminal 421 to the terminal 424, and the end section (the lower end section, the end section of the −Z axis direction side) of the mounting direction side of the circuit board 400, is not coated with a film. The portion which is not covered by the coating film is a region where the terminals 421 to 429 and an insulating base material are exposed as is to the outside. When the ink cartridge 10 is mounted, the surface of the circuit board 400 is moved in a state of being in contact with the apparatus side terminals 521 to 529. At this time, the apparatus side terminals 521 to 529 slide on the surface of the circuit board 400, but since a coating film is not formed, the coating film is not scraped off by the sliding. Due to this, it is possible to suppress contact problems with the apparatus side terminals 521 to 529 and the terminals 421 to 429 of the circuit board 400 which are caused by dust of the coating film 400 being attached to the apparatus side terminals 521 to 529.

For example, the terminals 421 to 424 which form the upper side row and the terminals 425 to 429 which form the lower side row respectively have the following functions (uses).

Upper Side Row (1) Excessive voltage detection terminal 421

(2) Reset terminal 422 (low voltage terminal)

(3) Clock terminal 423 (low voltage terminal)

(4) Excessive voltage detection terminal 424

Lower Side Row (5) Mount detection terminal 425 (high voltage terminal)

(6) Power source terminal 426 (low voltage terminal)

(7) Ground terminal 427

(8) Data terminal 428 (low voltage terminal)

(9) Mount detection terminal 429 (high voltage terminal)

The pair of excess voltage detection terminals 421 and 424 are terminals for performing detection of abnormally high voltage values (referred to as "excess voltage"). The pair of mount detection terminals 425 and 429 are terminals which are used for detecting whether the mounting state of the ink cartridge 10 is good or bad. Here, the excess voltage detection terminals 421 and 424 may be used for mount detection in addition to excess voltage detection. In the present embodiment, since a voltage (rated 42 V or 36 V) which is higher than a power source voltage (rated 3.3 V) for the storage device 403 is applied to the mount detection terminals 425 and 529, the above are referred to as "high voltage terminals" or "terminals for high voltage application". The other five terminals 422, 423, 426, 427, and 428 are terminals for the storage device 403. Out of the five terminals, since a voltage (rated 3.3 V) which is lower than the high voltage terminals 425 and 429 is applied to the four terminals 422, 423, 426, and 428 other than the ground terminal 427, the above are referred to as "low voltage terminals" or "terminals for low voltage application".

The contact sections cp which come into contact with the apparatus side ground terminal 527 are arranged at the center of the arrangement of the contact section row of the lower side of the cartridge side terminals. In addition, the contact section cp is arranged at the center of the width in the Y direction of the ink cartridge 10. As previously described, since the apparatus side ground terminal 527 is provided to protrude more than the other apparatus side terminals, a stronger force is applied to the contact section cp which comes into contact with the apparatus side ground terminal 527 than to the contact sections which come into contact with the other apparatus side terminals when the cartridge is mounted in the holder. By arranging the contact section cp where a stronger force is applied at the center of the arrangement of the contact section row of the cartridge side terminal, it is possible to prevent the posture of the ink cartridge being inclined due to the stronger force. That is, it is possible to maintain the ink cartridge in the stabilized correct posture. This effect is made more remarkable by arranging the contact section cp which comes into contact with the apparatus side ground terminal 527 at the center of the width in the Y direction of the ink cartridge 10. The ground terminal 427 is formed so as to pass through the center of a straight line L which joins the contact section cp of the terminal 425 (the high voltage terminal) and the contact section cp of the terminal 429 (the high voltage terminal). In addition, the area of the ground terminal 427 is larger than the area of the other terminals of the circuit board 400. The width (the size in the Y direction) of the ground terminal 427 and the widths of the other terminals 421 to 426 and 428 are approximately the same. On the other hand, the length of the ground terminal 427 (the size in the −Z direction, that is, the length in the cartridge mounting direction) is larger than the length of the other terminals 421 to 426 and 428. Due to the area of the ground terminal 427 being larger than the areas of the other terminals 421 to 426 and 428, the ground terminal 527 and the ground terminal 427 are brought into contact more reliably than the other terminals. Furthermore, due to the ground terminal 427 being longer than the other terminals 421 to 426 and 428, the ground terminal 527 and the ground terminal 427 come into contact before the other terminals. Due to this, it is possible to reduce the occurrence of faults as described above.

The circuit board 400 described above is positioned between the lever 11 and the edge of the bottom surface 10*b* in the left side surface 10*d* of the ink cartridge 10. In addition, the contact section cp is positioned between the lever 11 and the edge of the bottom surface 10*b* in the left side surface 10*d* of the ink cartridge 10. In a case where there are individual differences in the outer dimensions or the like of the ink cartridge 10, positional deviation occurs with regard to the circuit board 400 and the contact section cp with the abutting section 15 as the center of rotation. At this time, since the circuit board 400 and the contact section cp are positioned between the lever 11 and the edge of the bottom surface 10*b*, it is possible to reduce the positional deviation of the apparatus side terminals 521 to 529 and the contact section cp closer to the abutting section 15 compared to the other positions in the left side surface 10*d*. As a result, it is possible to suppress contact problems between the apparatus side terminals 521 to 529 and the terminals 421 to 429 of the circuit board 400.

In addition, the upper side row is formed by the four terminals 421 to 424 and the lower side row is formed by the five terminals 425 to 429 which is a higher number than the upper side row. With regard to the positional deviation of the circuit board 400 with the abutting section 15 as the center of rotation, since the lower side row is closer to the abutting section 15 than the upper side row, it is possible to reduce the positional deviation of the lower side row where the number of terminals is larger than the upper side row where the number of terminals is smaller. In addition, the contact section row of the upper side includes four of the contact sections and the contact section row of the lower side includes five of the contact sections. With regard to the positional deviation of the contact sections with the abutting section 15 as the center of rotation, since the contact section row of the lower side is closer to the abutting section 15 than the contact section row of the upper side, it is possible to reduce the positional deviation of the contact sections of the lower side of which the number is larger than the contact sections of the upper side of which the number is smaller.

Here, in the present embodiment, the terminals 421 to 429 and the storage device 403 are provided on one circuit board 400, but the terminals 421 to 429 and the storage device 403 may be each provided on separate circuit boards 400. In addition, only the terminals 421 to 429 may be provided in the left side surface 10*d* of the ink cartridge 10 and the storage device 403 may be provided on the other side surface. In addition, the terminals 421 to 429 may be directly provided on the left side surface 10*d* of the ink cartridge and not on the circuit board. In addition, the circuit board 400 may be attached such that attachment and detachment are possible with regard to the left side surface 10*d* of the ink cartridge 10. In addition, the terminals 421 to 429 need not have a rectangular shape as shown in FIG. 12A. In addition, the terminals 421 to 429 need not be arranged in vertical rows and need not be arranged with a zigzag shape. That is, the terminals 421 to 429 may be designed with a shape and an arrangement such that it is possible to come into contact with the apparatus side terminal 520 which is provided in the holder 50 and are not limited to the shape and arrangement as shown in FIG. 12A.

Modified Example 1

In the embodiment described above, an example of applying the present invention to an on-carriage type printing apparatus where the holder is on the carriage has been described, but it is also possible to apply the present invention to an off-carriage type printing apparatus where the holder is in a location other than the carriage.

Modified Example 2

In the embodiment described above, an example where the present invention is applied to a printing apparatus and ink cartridges has been described, but a printing apparatus may be used which ejects or discharges another liquid other than ink. In addition, it is possible to use the present invention in various types of printing apparatus which are provided with liquid ejecting heads or the like which discharge liquid droplets in minute amounts. "Liquid droplets" refers to a state of the liquid which is discharged from the printing apparatus and includes droplets which have a trail in a granular shape, a teardrop shape, or a thread shape. In addition, it is sufficient if the "liquid" as used here is a material which is able to be ejected by a printing apparatus. For example, it is sufficient if the material is in a state where a substance is in a liquid phase and the materials include those with liquid states with high or low viscosity and flow states such as sols, gel water, other inorganic solvents, organic solvents, solutions, liquid resins, and liquid metals (metal melts), and not only liquids as one state of a substance, but also materials where particles of functional materials formed from solid matter such as a pigment or metal particles are dissolved, dispersed or mixed, and the like. In addition, typical examples of the liquid include ink as described in the embodiment described above, liquid crystals, or the like. Here, the ink includes various types of liquid compositions such as gel inks and hot melt inks in addition to typical water based inks and oil based inks. Specific examples of the printing apparatus may be, for example, a printing apparatus for ejecting a liquid which includes a material such as an electrode material, a color material, or the like which is used in the manufacturing of a liquid crystal display, an EL (electroluminescence) display, a surface-emitting display, a color filter in a dispersed or dissolved form, a printing apparatus which ejects biological organic matter which is used in the manufacturing of biochips, or a printing apparatus which ejects a liquid which is a sample which is used as a precision pipette. Furthermore, a printing apparatus which ejects a lubricant in a pin point manner into precision machines such as watches or cameras, a printing apparatus which ejects a transparent resin liquid such as ultraviolet ray curable resin onto a substrate for forming a micro hemispherical lens (an optical lens) which is used for optical communication elements or the like, a printing apparatus which ejects an etching liquid such as an acid or an alkali for etching a substrate or the like, may be adopted.

The invention claimed is:

1. An ink cartridge configured to be mounted in a mounting direction into a holder of a printer, the ink cartridge comprising:

a first surface;

a second surface facing the first surface;

a third surface having a first end section adjacent to the first surface and a second end section adjacent to the second surface; and a pressing section provided in the first surface and pressing the ink cartridge toward a second surface side when the ink cartridge is mounted in the holder, the third surface having a detection section configured and arranged to optically detect a remaining state of ink which is contained in the ink cartridge, and an abutting section protruding from the third surface so that a distal end surface of the abutting section abuts against the holder in the mounting direction in order to make a space between the holder and another section of the third surface other than the abutting section when the ink cartridge is mounted in the holder, wherein a distance between the detection section and the second end section is shorter than a distance between the detection section and the first end section in the third surface, and the abutting section is positioned between the detection section and the second end section.

2. The ink cartridge according to claim 1, wherein the third surface further has an ink supply port which supplies ink to the printer when the ink cartridge is mounted in the holder, and a distance between the ink supply port and the second end section is longer than a distance between the ink supply port and the first end section in the third surface.

3. The ink cartridge according to claim 1, wherein the abutting section protrudes from the third surface.

4. The ink cartridge according to claim 1, wherein an angle formed by a mounting direction of the ink cartridge into the holder and the third surface is 90 degrees or less when the ink cartridge is mounted in the holder.

5. The ink cartridge according to claim 1, wherein the abutting section is formed by a member which absorbs light.

6. The ink cartridge according to claim 1, wherein the first surface further has a plurality of cartridge side terminals having contact sections electrically connected to a plurality of apparatus side terminals provided in the holder, and the contact sections are positioned in the first surface between the pressing section and the first end section.

7. The ink cartridge according to claim 6, wherein the contact sections are arranged in a first contact section row and a second contact section row which are arranged in a direction intersecting with a mounting direction of the ink cartridge into the holder, the first contact section row is positioned in the first surface between the first end section and the second contact section row, and a number of the contact sections which are included in the first contact section row is larger than a number of the contact sections which are included in the second contact section row.

8. The ink cartridge according to claim 7, wherein the number of the contact sections which are included in the first contact section row is an odd number, and one of the cartridge side terminals, which includes the contact section positioned in a center of the first contact section row, is a ground terminal.

9. The ink cartridge according to claim 8, wherein an area of the ground terminal is larger than an area of the cartridge side terminals other than the ground terminal.

10. The ink cartridge according to claim 7, wherein the cartridge side terminals are provided in a surface of a circuit board, and a region on the surface of the circuit board excluding a region between the first terminal row and an end section with respect to the mounting direction is coated with a film.

11. A printer comprising:

the holder where the ink cartridge according to claim 1 is mounted.

* * * * *